US011247793B2

(12) United States Patent
Van Nispen et al.

(10) Patent No.: US 11,247,793 B2
(45) Date of Patent: Feb. 15, 2022

(54) METHOD AND APPARATUS FOR PACKAGING RESPIRING PRODUCE

(71) Applicant: PERFO TEC B.V., Woerden (NL)

(72) Inventors: Harm Van Nispen, Leveroy (NL); Bastiaan Rinke Antony Groeneweg, Woerden (NL); Willem Martijn De Bruin, Woerden (NL)

(73) Assignee: PERFO TEC B.V.

( * ) Notice: Subject to any disclaimer, the term of this patent is extended or adjusted under 35 U.S.C. 154(b) by 88 days.

(21) Appl. No.: 16/483,685

(22) PCT Filed: Feb. 8, 2018

(86) PCT No.: PCT/NL2018/050089
§ 371 (c)(1),
(2) Date: Aug. 5, 2019

(87) PCT Pub. No.: WO2018/147736
PCT Pub. Date: Aug. 16, 2018

(65) Prior Publication Data

US 2020/0122868 A1 Apr. 23, 2020

(30) Foreign Application Priority Data

Feb. 8, 2017 (NL) ..... 2018335

(51) Int. Cl.
*B65B 25/04* (2006.01)
*B65B 9/10* (2006.01)
(Continued)

(52) U.S. Cl.
CPC ..... *B65B 25/041* (2013.01); *B65B 9/10* (2013.01); *B65B 31/044* (2013.01); *B65B 57/10* (2013.01); *B65B 61/02* (2013.01)

(58) Field of Classification Search
CPC ..... B65B 25/02; B65B 25/04; B65B 25/041; B65B 31/041; B65B 31/044; B65B 31/045
(Continued)

(56) References Cited

U.S. PATENT DOCUMENTS 2,960,808 A * 11/1960 Pike ..... B65B 31/045 53/551
2,962,843 A * 12/1960 Hoelzer et al. ..... B65B 9/24 53/551
(Continued)

FOREIGN PATENT DOCUMENTS

EP 0351115 B1 3/1995
EP 1935787 B1 6/2011
(Continued)

OTHER PUBLICATIONS

Kim, Ji Gang, et al. "Effect of initial oxygen concentration and film oxygen transmission rate on the quality of fresh-cut romaine lettuce." Journal of the Science of Food and Agriculture 85.10 (2005): pp. 1622-1630.
(Continued)

*Primary Examiner* — Stephen F. Gerrity
(74) *Attorney, Agent, or Firm* — Mendelsohn Dunleavy, P.C.

(57) ABSTRACT

A method of manufacturing a modified atmosphere package is provided which comprises the steps of: providing a portion of packaging material; providing a portion of produce; forming, from the portion of packaging material and the portion of produce, a closed package defining a package volume and containing in the package volume the portion of produce and a modified atmosphere. The modified atmosphere is modified with respect to the ambient atmosphere. The method comprises providing the modified atmosphere in the package volume by providing a gas mixture of at least
(Continued)

one atmosphere modification gas and pressurised air in the package volume. An associated apparatus is also provided.

20 Claims, 3 Drawing Sheets

(51) Int. Cl.
*B65B 31/04* (2006.01)
*B65B 57/10* (2006.01)
*B65B 61/02* (2006.01)

(58) Field of Classification Search
USPC ..... 53/433, 511
See application file for complete search history.

(56) References Cited

U.S. PATENT DOCUMENTS

| | | | | |
|---|---|---|---|---|
| 3,579,945 | A * | 5/1971 | Buchner et al. | B65B 31/045 53/511 |
| 3,789,888 | A * | 2/1974 | James et al. | B65B 31/045 53/433 |
| 5,565,230 | A * | 10/1996 | Bailey | B65B 25/041 426/316 |
| 5,822,951 | A * | 10/1998 | Rosik | B65B 31/02 53/432 |
| 6,441,340 | B1 | 8/2002 | Varriano-Marston | |
| 6,730,874 | B2 | 5/2004 | Varriano-Marston | |
| 6,735,928 | B2 * | 5/2004 | Kondo et al. | B65B 31/045 53/433 |
| 7,083,837 | B1 | 8/2006 | Varriano-Marston | |
| 7,950,207 | B2 | 5/2011 | Maisel | |
| 9,809,377 | B2 * | 11/2017 | Adam | B65B 25/041 |
| 2012/0269459 | A1 * | 10/2012 | Howes | B65B 31/04 53/408 |
| 2016/0068288 | A1 * | 3/2016 | Palumbo | B65B 31/028 53/511 |
| 2016/0122051 | A1 * | 5/2016 | Andersson | B65B 31/045 53/432 |
| 2017/0233122 | A1 * | 8/2017 | Thomas et al. | B65B 31/04 53/434 |
| 2017/0268996 | A1 | 9/2017 | Krottmaier et al. | |

FOREIGN PATENT DOCUMENTS

| | | | | |
|---|---|---|---|---|
| EP | 2905233 | A1 | 2/2014 | |
| FR | 2815013 | A1 | 4/2002 | |
| FR | 2819235 | A1 * | 7/2002 | B65B 31/045 |
| FR | 2873992 | A1 | 2/2006 | |
| GB | 1070320 | A | 6/1967 | |
| GB | 2510377 | A | 8/2014 | |
| JP | S63-59834 | A | 3/1988 | |
| JP | H04-133188 | U | 12/1992 | |
| WO | WO9322207 | A1 | 11/1993 | |
| WO | WO0212068 | A1 | 2/2002 | |
| WO | WO2006063609 | A1 | 6/2006 | |
| WO | WO2009132663 | A1 | 11/2009 | |
| WO | WO2014129904 | A1 | 8/2014 | |
| WO | WO2015172166 | A1 | 11/2015 | |

OTHER PUBLICATIONS

Sanz, C., et al. "Quality of strawberries packed with perforated polypropylene." Journal of Food Science 64.4 (1999): pp. 748-752.
Jacxsens, Liesbeth, et al., "Validation of a systematic approach to design equilibrium modified atmosphere packages for fresh-cut produce." LWT-Food Science and Technology 32.7 (1999): 425-432.
International Search Report and Written Opinion for International Application No. PCT/NL2018/050089; dated Apr. 16, 2018.
Notice of Reasons for Rejection for corresponding Japanese application No. 2019-564001; dated Nov. 15, 2021 (7 pages).

* cited by examiner

METHOD AND APPARATUS FOR PACKAGING RESPIRING PRODUCE

TECHNICAL FIELD

The present disclosure relates to packaging of respiring produce, in particular flowers, vegetables, fruits and/or herbs, more in particular vegetables, fruits and/or herbs that are minimally processed.

BACKGROUND

Natural produce such as flowers, vegetables, fruits and/or herbs tend to respire after being harvested. The respiration continues for prolonged periods, in particular if the produce has undergone little to no processing, e.g. having been washed and possibly peeled and/or chopped up, but otherwise fresh and uncooked. When such produce is packaged, the atmosphere within the package is affected by the respiring produce. Conversely, an atmosphere surrounding produce affects the respiration, maturation, aging and/or deterioration of the packed produce.

It has therefore become customary to package fresh produce in packages with a modified atmosphere (Modified Atmosphere Package or MAP) or with a controlled atmosphere (Controlled Atmosphere Package or CAP). In MAP the produce is packaged and an artificial gas mixture is used to establish a distinct interior atmosphere in the package, which may however change later on due to the respiration of the packed produce. In CAP the produce is packaged and the composition of the package atmosphere is controlled by including an active absorber for an atmosphere component, e.g. an oxygen scavenger or by adapting transmission of the packaging material to allow exchange with an exterior atmosphere outside the package. Modified and controlled atmosphere packaging (MAP/CAP) preserve produce quality by reducing the aerobic respiration rate but avoiding anaerobic processes that may lead to adverse changes, e.g. in one or more of colour, texture, flavour and aroma.

E.g., as explained in U.S. Pat. No. 7,083,837, the quality and shelf life of many food products is enhanced by enclosing them in packaging that modifies or controls the atmosphere surrounding the product. Increased quality and longer shelf life result in fresher products for the consumer, less waste from spoiled produce, better inventory control, and appreciable overall savings for the food industry at both the retail and wholesale levels. U.S. Pat. No. 7,083,837 discusses that in MAP, sometimes the package is gas-flushed with $N_2$ or a combination of $CO_2$ and $N_2$, or a combination of $O_2$, $CO_2$, and $N_2$ before sealing the package to rapidly establish the desired gas composition inside the package. U.S. Pat. No. 7,083,837 further discusses that in CAP the package may (micro-)perforated.

Providing packages and packaging material with perforations is also disclosed in, e.g., EP 0 351 115, WO 93/22207, U.S. Pat. Nos. 6,441,340, 6,730,874, WO 02/12068, US 2003/029850, WO 2006/063609, FR 2,873,992, WO 2009/132663 and EP 1 935 787, and in scientific literature such as L. Jacxsens et al, "Validation of a systematic approach to design equilibrium modified atmosphere packages for fresh-cut produce", Lebensm. Wiss. u. Technol. 32:425-432 (1999), C. Sanz et al, "Quality of strawberries packed with perforated polypropylene" J. Food Sci. 64:748-752 (1999) and J. G. Kim et al, "Effect of initial oxygen concentration and film oxygen transmission rate on the quality of fresh-cut romaine lettuce", J. Sci. Food. Agric. 85:1622-1630 (2005).

WO 2014/129904 discloses that a combination of MAP and CAP may be used.

In common MAP packaging apparatus and methods, the modified atmosphere is established by flushing the produce filled package and/or the location where the package is to be closed with one or more pure gases thus establishing an operative atmosphere comprising a surplus amount of the pure gas; the actual modified atmosphere within the package is then the result of a mixture of the flushing gas and the ambient atmosphere. These methods result in inaccurate composition of the modified atmosphere. Further, this slows down the packaging process significantly, e.g. by 50% when compared to a process without gassing, and thus raises the costs of the packages obtained. Moreover, the packaging costs are raised by the gases and by losing these gases to the ambient atmosphere.

Improved Modified Atmosphere Packages and methods of producing them more cost-efficient are therefore desired.

SUMMARY

In view of the preceding, herewith a method and apparatus according to the present disclosure, and in particular according to the appended claims, are provided.

In an aspect, therefore, a method of manufacturing a modified atmosphere package is provided which comprises the steps of: providing a portion of packaging material;

providing a portion of produce;

forming, from the portion of packaging material and the portion of produce, a closed package defining a package volume and containing in the package volume the portion of produce and a modified atmosphere;

wherein the modified atmosphere is modified with respect to the ambient atmosphere;

wherein the method comprises providing the modified atmosphere in the package volume by providing a gas mixture of at least one atmosphere modification gas and pressurised air in the package volume.

According to the presently provided principles, the atmosphere modification gas is mixed with pressurised air, which is relatively cheap compared to pure gases or pure gas mixtures. This facilitates a thorough mixing of the air and the modification gas to produce the gas mixture to a desired composition in an effective and cost-efficient manner, compared to mixing one or more modification gases with ambient air in or near the package, as customary. Composition of the gas mixture may therefore be better controllable. Further, this enables flushing the package volume and replacing an initial atmosphere therein more forcefully with reduced loss of atmosphere modification gas compared to the known techniques. Also and/or alternatively, the gas mixture may be provided with less turbulence otherwise needed for mixing ambient atmosphere with the atmosphere modification gas, which reduces or prevents stirring up the produce in the package and/or when filling the package with the produce. Thus, the packaging process may be accelerated.

The packaging material may be film, e.g. a polymer film, which may be a laminate film. Suitable polymer films are generally known and include films made of polyethylene, polypropylene, polyester, polyamide, and cellophane, in monolayers and laminates. The package may be formed as a flexible bag or pouch and/or at least part of it may be formed as a formed tray or box which may be sealed with a formed lid and/or a sealing film. A flexible bag or pouch may deform significantly under the shape and/or weight of the produce and may be suitable for robust produce and/or produce packaged in small elements, e.g. a bag of Brussels sprouts or cut lettuce, whereas a tray or a box may be substantially shape-retaining for protecting large and/or delicate produce like mushrooms or fruits such as apricots, berries etc.

The at least one atmosphere modification gas may comprise nitrogen, argon, carbon dioxide, oxygen, ethylene, etc.

The modified atmosphere may typically have a reduced oxygen concentration compared to the ambient atmosphere, e.g. between 6% and 10% oxygen, or even lower to, e.g., an $O_2$ concentration <4%, e.g. <2% such as 0.5-1%, instead of about 21% in ambient air (volume percentages). Also or alternatively it may have an elevated concentration of carbon dioxide, e.g. between 6% and 10% carbon dioxide, or even up to 20% instead of about 0.04% in ambient air (volume percentages). The gas mixture may be composed of pressurised air and the at least one atmosphere modification gas to certain fractions to obtain a desired gas mixture composition. The desired composition of the gas mixture may differ from a desired composition of the modified atmosphere, e.g. to account for remaining ambient air and/or (contributions of) ambient air entrapped in with the portion of produce when closing the package, etc.

The method may comprise providing the pressurised air by compressing air taken from the ambient atmosphere at or near a location where the method is performed, e.g. taking in and compressing air "on line" with manufacturing the modified atmosphere package, possibly also comprising filling a buffer volume. This facilitates a cost reduction and obviates providing an external supply, e.g. a bottle bought from an external supplier. Air taken from the ambient atmosphere may be at least one of filtered, cleaned, dried, heated, cooled and otherwise conditioned at least one of prior to, during and after compression, and prior to mixing with the atmosphere modification gas.

The step of modifying the atmosphere may comprise mixing at least one atmosphere modification gas, possibly several atmosphere modification gases, and the pressurised air to a gas mixture, and introducing at least a portion of the gas mixture into the package volume at elevated pressure. The mixing may be done in a mixing chamber and/or a manifold from which the mixed gas mixture is supplied, e.g. flown, to an actual location of providing the gas mixture in the package volume. The gas mixture may be supplied at a desired flow rate (e.g. determined in liters per minute or per hour) and/or at a desired pressure, e.g. the pressure of the pressurised air, the pressure of one or more of the atmosphere modification gases, or a summation of two or more of these pressures, but a modified pressure, e.g. further elevated pressure or in particular a reduced pressure may be preferred.

In an embodiment, the method comprises measuring at least one of the composition, an amount and a flow rate of at least one of air to be pressurised into the pressurised air, the pressurised air, the atmosphere modification gas and the gas mixture, prior to introducing the gas mixture into the packaging space.

In an embodiment, the step of forming the package containing the portion of produce and the atmosphere is performed in a packaging space, in particular a substantially enclosed space such as a bag filling tube and/or a tray sealing space, and the method comprises introducing the gas mixture in the packaging space, and wherein the packaging space comprises a gas inlet and a gas outlet and wherein the method comprises measuring at least one of a composition, an amount and a flow rate of gas at or near the gas outlet.

These latter embodiments, which may also be used in methods of manufacturing a modified atmosphere package not relying on pressurised air but on other gas mixtures, enable quality control of the gas mixture and possibly adjustment of the composition of the gas mixture. In the former embodiment, features of the gas mixture entering the packaging space may be monitored. In the latter embodiment establishment and/or maintenance of a desired packaging space atmosphere composition may be monitored and loss of gas mixture from the packaging space may be prevented by timely reducing supplying one or more components of the gas mixture to the packaging space. Note that the gas outlet may be a produce inlet, in particular in a vertical packager with a produce chute, see below. The measurement and/or the optional adjustment may be done by an operator and/or automated by a controller.

The method may comprise providing the packaging material with one or more microperforations, for establishing a desired gas and/or humidity transmission rate through the packaging material different from respective transmission rates of the packaging material proper. Thus, the package may be formed as a Controlled Atmosphere Package in which a target package atmosphere, in particular an equilibrium atmosphere, is established and/or maintained by interaction, preferably a balance, between respiration of the produce on the one hand and gas exchange between the package atmosphere and the atmosphere surrounding the package on the other hand. The target package atmosphere, and thus the number and/or size of the microperforations, therefore will usually vary for different types of produce (flowers, vegetables, leafy vegetables, fruits and herbs, spices; washed, peeled, cut, otherwise processed or not processed) and may vary between different batches of the same type. One or more respiration properties of the produce may be determined of at least a portion of (a batch of) the produce to determine the target package atmosphere, e.g. which oxygen concentration, carbon dioxide concentration and/or ethylene concentration the target package atmosphere should have.

With such in mind, the method may comprise determining a respiration property of the produce to be packaged and determining on the basis of the determined respiration property of the produce to be packaged a composition of the modifying atmosphere, and—if applicable—a number of microperforations to be made and/or a size of the one or more microperforations to be made.

Providing the packaging material with one or more microperforations may be done with one or more mechanical perforators, e.g. needles which may optionally be heated, and/or electromagnetic perforators e.g. lasers. The latter have proven to be reliable tools for making microperforations suitable for packaging produce, with typical sizes in a range of 50 to 500 micrometer diameter, in particular in ranges of 70-120 micrometers, but ranges of 150-250 and/or of 250-350 micrometers may also be suitable. The number of microperforations may generally vary from 1 to 10 or 15 per package, some produce may require several tens or up to a few hundreds of microperforations. Monitoring, in particular imaging (photographing and/or filming) microperforations, in particular on-line, allows for quality control, adjustment and/or other feedback, e.g. by measuring an open area of some or, preferably, each microperforation.

An embodiment comprises modifying the atmosphere in the package to substantially the target package atmosphere. Thus, the produce may be brought at least close to its equilibrium state for prolonged quality and shelf life immediately on packaging. However, it may be preferred to modify intentionally the atmosphere of the package to a composition differing from the target package atmosphere, e.g. in view of particular storage and/or transportation criteria and/or circumstance benefiting a different package atmosphere.

The method may comprise manufacturing a series of modified atmosphere packages as presently provided, wherein for each package of the series the step of forming the package containing the portion of produce and the atmosphere is performed in a packaging space, wherein the method comprises providing the packaging space with the gas mixture, e.g. flowing the space, before and/or after forming successive packages, possibly in dependency to a rate of manufacturing successive packages. Thus, the series of modified atmosphere packages may be manufactured without having to repeatedly start and stop the gas mixture, or rather to provide too much or too little of the gas mixture for the manufacturing speed of the packages. This facilitates and accelerates the manufacturing process and improves constancy between the composition of the package atmosphere of successive packages.

Also in view of the preceding, with benefits and reasons applying mutatis mutandis, in an aspect an apparatus for manufacturing a modified atmosphere package is provided. The apparatus comprises: a device for forming, from a portion of packaging material and a portion of produce, a closable package when closed defining a package volume and containing in the package volume the portion of produce and a modified atmosphere, i.e. modified with respect to the ambient atmosphere; a supply of pressurised air and a supply of at least one atmosphere modification gas; and a device for providing a gas mixture of the at least one atmosphere modification gas and the pressurised air in the package volume.

The apparatus enables manufacturing a modified atmosphere package effectively and cost-efficiently.

The device for providing the gas mixture may comprise a manifold from which a gas supply conduit may run to supply the gas mixture to an actual location of providing the gas mixture in the package volume, e.g. by flow due to a pressure of the air and/or the at least one atmosphere modification gas.

Although the packages may be closed by other means, e.g. by hand, the apparatus is preferably configured to close, e.g. seal, the package, to expedite the manufacturing process and possibly to increase hygiene.

The apparatus may comprise a supply of packaging material, e.g. a reel of packaging film and/or a supply of produce, e.g. filled hopper. The apparatus may comprise a transporter for empty packages and/or for filled packages. The apparatus may comprise a transporter for produce at least one of into the packaging material, onto the packaging material, and into a package.

In an embodiment the apparatus comprises a gas inlet for supplying the gas mixture in or near the package, and at least one gas sensor positioned upstream of the inlet, wherein the gas sensor is configured to detect at least one component of the gas mixture, in particular the at least one atmosphere modification gas. In this text "upstream" and "downstream" refer to the direction of gas flow, i.e. from the supply of pressurised air and/or the supply of at least one atmosphere modification gas toward the package and/or a gas outlet.

In an embodiment, the apparatus comprises a gas inlet for supplying the gas mixture in or near the package, wherein the apparatus comprises at least one of a gas outlet and a produce inlet for supplying the produce to the apparatus and/or to the package, positioned downstream of the gas inlet, and wherein the apparatus comprises at least one gas sensor positioned downstream of the inlet and upstream of, or at or near, the gas outlet and/or the produce inlet, wherein the at least one gas sensor is configured to detect at least one component of the gas mixture, in particular the at least one atmosphere modification gas.

These embodiments enable measuring the gas composition, e.g. for quality and/or feedback purposes. The latter embodiment may also reduce loss of valuable gas from the apparatus; note that a produce inlet may also form a gas outlet. In some embodiments a produce inlet may be provided with selectively closable passages as a lock for maintaining a packaging apparatus atmosphere within the packaging apparatus, modified with respect to the ambient atmosphere, and for reducing (atmosphere modification) gas loss through the produce inlet.

In a particular embodiment, the apparatus comprises an enclosed produce supply channel, e.g. a pipe such as a chute, having a produce filling end and a packaging end, wherein the apparatus is configured for filling the package at or near the packaging end with produce supplied through the channel, e.g. by gravity, wherein the apparatus comprises a gas inlet into the produce supply channel for supplying the gas mixture at or near the packaging end into the produce supply channel, and wherein the apparatus comprises at least one gas sensor upstream of the gas inlet and/or at least one gas sensor at or near the filling end, and wherein the gas sensor is/the gas sensors are configured to detect at least one component of the gas mixture, in particular the at least one atmosphere modification gas. Such embodiment is particularly efficient for filing bags with produce, e.g. loose leaf salads and/or cut salads. Using the sensors the package atmosphere may be reliably established and gas loss from the produce filling end may be reduced or prevented. The apparatus may be configured to produce packages at or near the packaging end substantially simultaneously, e.g. forming successive bags from a continuous web of film for filling each bag from the channel during and/or shortly after forming the bag. Such bag forming may include first forming a tube from the web material around the channel so that the packaging end of the channel is substantially constantly closed off by the packaging material and a substantially constant local atmosphere may be established at or near the packaging end.

In an embodiment comprising at least one sensor, the apparatus may comprise a controller operably connected with the at least one gas sensor, preferably with plural gas sensors when present, and wherein the controller is operably connected with one or more regulators for controlling at least one of a composition and a flow of the gas mixture, in response to a signal from the at least one gas sensor, e.g. controller operable valves, and/or wherein the controller is operably connected with the device for forming a package, e.g. a supply of packaging material and/or a supply of produce.

Thus a feedback system may be provided; the composition and/or flow of the gas mixture may be regulated together with the device for forming a package, e.g. to accommodate for variations in packaging speed and/or to accommodate a packaging speed to variations in the composition and/or flow of the gas mixture. This facilitates improving one or more of quality control, production continuity, gas containment (i.e. reduction of gas loss and/or flushing out unwanted gas components), etc.

In an embodiment, the apparatus comprises an enclosed produce supply channel, e.g. a pipe such as a chute, having a produce filling end and a packaging end, wherein the apparatus is configured for filling the package at or near the packaging end with produce supplied through the channel, e.g. by gravity, wherein the apparatus comprises a plurality of gas inlets into the produce supply channel for supplying the gas mixture at or near the packaging end into the produce supply channel, and/or the supply channel comprises at least partially a double wall providing a gas flow channel inside the double wall and comprising a plurality of gas inlets into the produce supply channel and/or a gas inlet having an inlet opening extending for more than about 25% of the circumference of the channel inner wall, preferably at least 50% of the circumference, more preferably in a range of about 75% to substantially the entire circumference, for supplying the gas mixture at or near the packaging end into the produce supply channel.

This may facilitate a smooth outflow of the gas, controlling, reducing and/or preventing turbulence at or near the packaging end and/or the package. As a result, the produce may be transported through the supply channel more smoothly and easily. Also spilling and/or misplacement of produce which might end up in a sealing location and/or in a package seal may be prevented, which would be inacceptable and cause losses.

In a particular embodiment, the channel is formed as a substantially coaxial double walled pipe. An at least partly double walled channel may prevent unhygienic mountings of separate gas ducts in the channel.

In an embodiment the apparatus comprises a perforator for providing the packaging material with one or more microperforations. Further, a controller for the perforator and/or for control of (operation of) other parts of the apparatus may be provided, e.g. a camera. Also or alternatively, a sensor and/or controller for determining a target package atmosphere may be provided.

It is noted that various embodiments may also be used beneficially without a supply of pressurised air.

BRIEF DESCRIPTION OF THE DRAWINGS

The above-described aspects will hereafter be more explained with further details and benefits with reference to the drawings showing a number of embodiments by way of example.

DETAILED DESCRIPTION OF EMBODIMENTS

Figure 1:
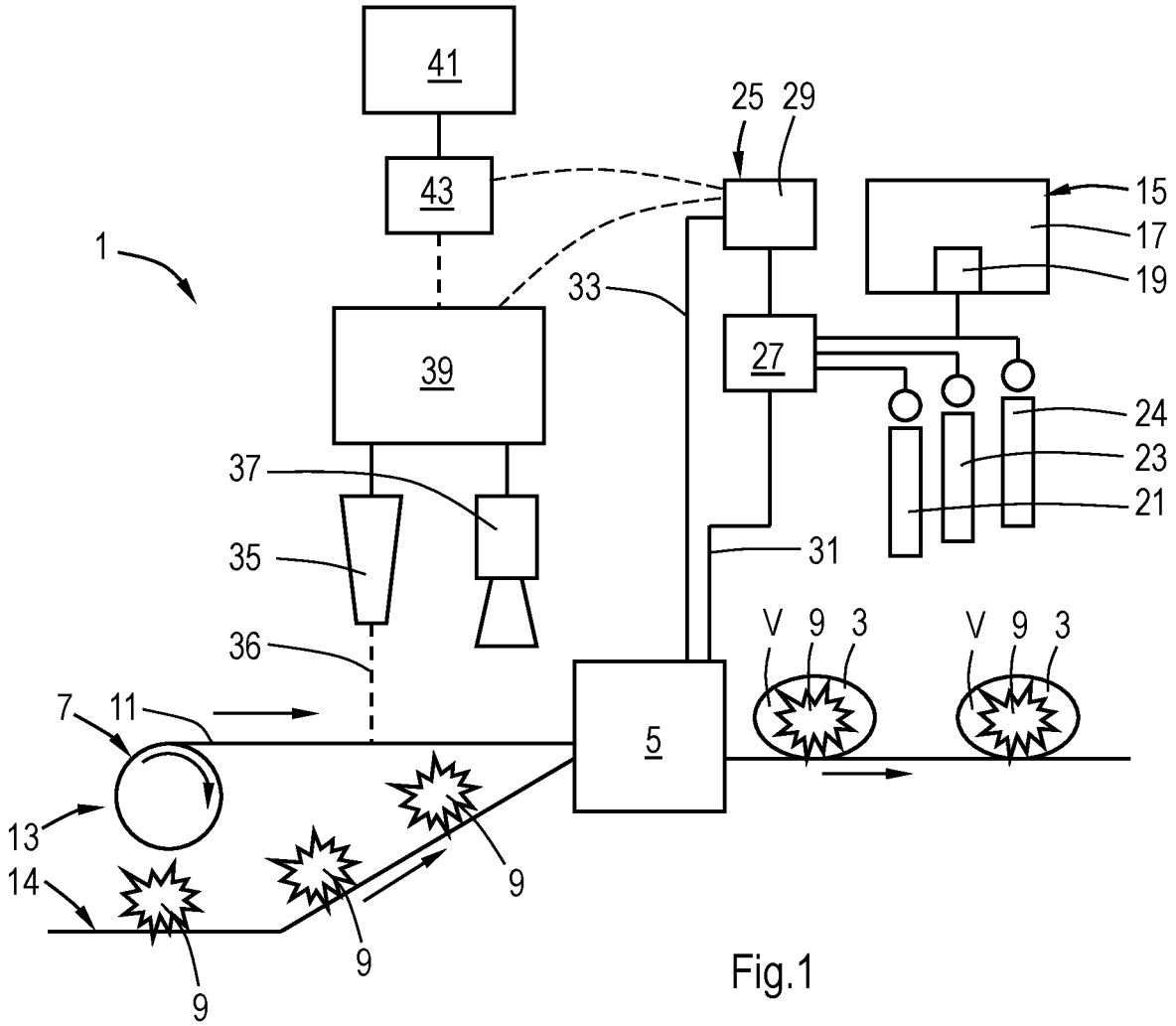
FIG. 1 schematically shows an embodiment of an apparatus and indicates at least part of an embodiment of a method.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified. Further, elements that are at least substantially identical or that perform an at least substantially identical function are denoted by the same numeral, where helpful individualised with alphabetic suffixes.

FIG. 1. shows schematically an apparatus 1 for manufacturing modified atmosphere packages 3. The apparatus 1 comprises a package forming device 5 for forming, from portions of packaging material 7 and portions of produce 9, modified atmosphere packages 3 each defining a package volume V and containing in the package volume V a portion of produce 9 and a modified atmosphere. Here, the packaging material is supplied as a web of a packaging film 11 on a roll 13 for forming bags but other forms and types of packaging material are also possible; e.g. two or more types of packaging material may be provided, such as trays and sealing film (not shown). In FIG. 1 the produce is provided as separate portions 9 by a produce transporter 14, but other ways of providing the produce as, or into, portions 9 may be used. Here, the apparatus 1 is configured to form and fill the packages 3 and also to close and separate them.

The apparatus 1 comprises a supply 15 of pressurised air, here in the form of a compressor 17 provided with filters 19, and supplies 21, 23 of different atmosphere modification gases, e.g. $CO_2$ and $N_2$, here in the form of gas bottles. The compressor is provided with a buffer tank 24.

Filtering of the pressurised air may comprise plural filtering steps, and may comprise reducing at least one of dust, liquids, gases from the ambient air. Suitable filters may comprise particle filters, (activated) carbon filters, gas scrubbers, dryers, etc.

Preferably, the atmosphere modification gas(es) is (are) also supplied pressurised so that both the pressurised air and the atmosphere modification gas(es) are at elevated pressure relative to the ambient atmosphere and may be transported by flowing under their own pressure so that one or more propellers are not needed; however, these may be provided.

The pressurised air may have a pressure of below 5 bar, e.g. below 2 bar such as 0.5 to 1.5 bar overpressure (1 bar=100 kPa). The atmosphere modification gas may have a similar pressure; if gas supplies are used with high filling pressures of up to about 200 bar overpressure, as usual, a reduction valve should preferably be used.

The apparatus 1 comprises a device 25 for providing a gas mixture of one or more of the atmosphere modification gas from the supplies 21, 23 and the pressurised air from the supply 15 in the package volume V of each package 3 as that is formed. Here, the device 25 comprises a manifold 27 connected by a gas supply conduit 31 to the package forming device 5. The manifold 27 and an optional feedback sensor signal line 33 are connected to a controller 29.

Figure 2:
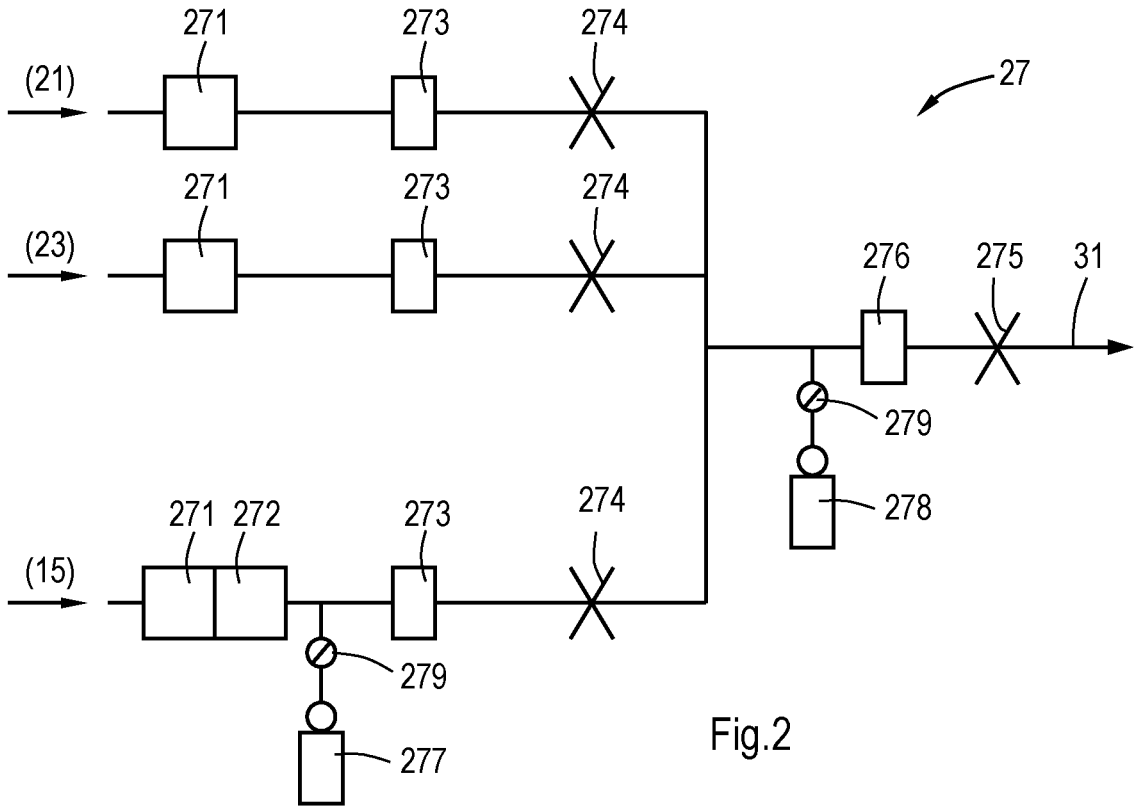
FIG. 2 schematically shows a gas mixing system.

Also referring to FIG. 2, a suitable manifold 27 may comprise for one or each of the (supplies 21, 23 of) atmosphere modification gases and/or for the (supply 15 of) pressurised air, a regulator 271, e.g. a pressure regulator and/or a flow controller, possibly combined with a filter 272, a controller-operable valve 273 and/or a hand-operable valve 274. The manifold serves for combining the atmosphere modification gases and the pressurised air as a gas mixture into the gas supply conduit 31, which may also be provided with a controller-operable and/or a hand-operable valve 275. Further, a gas composition sensor 276 may be provided. Additionally, one or more buffer tanks 277, 278 for pressurised air and/or the gas mixture may be provided, also with controller and/or hand operable valves 279.

As indicated in FIG. 1, the apparatus 1 further comprises a perforator, here a (possibly pulsed) laser 35 providing a (pulsed) laser beam 36, and a camera 37 for imaging microperforations and/or other control processes. The laser 35 and the camera 37 are operably connected with a perforation controller 39 for operational control, quality control and/or feedback control of the laser 35. The controller 39 may be programmable for determining one or more of the number, size and positions of the microperforations.

Further, not shown in any detail, the apparatus 1 may comprise a detector 41 and a calculator 43 configured to determine, e.g. by measuring and calculating on the basis of measurement results, one or more respiration properties, e.g. an $O_2$ consumption and/or $CO_2$-production of the produce to be packaged and, based on that/those, determining one or more of a composition of the target modified atmosphere, a composition of the modifying atmosphere, a number and/or size of one or more microperforations (to be) made in the packaging material of the package(s).

Two or more of the gas mixture controller 29, the perforation controller 39, the detector 41 and the calculator 43 may be interconnected (e.g. see dashed lines) and/or integrated in one combined controller.

Figure 3:
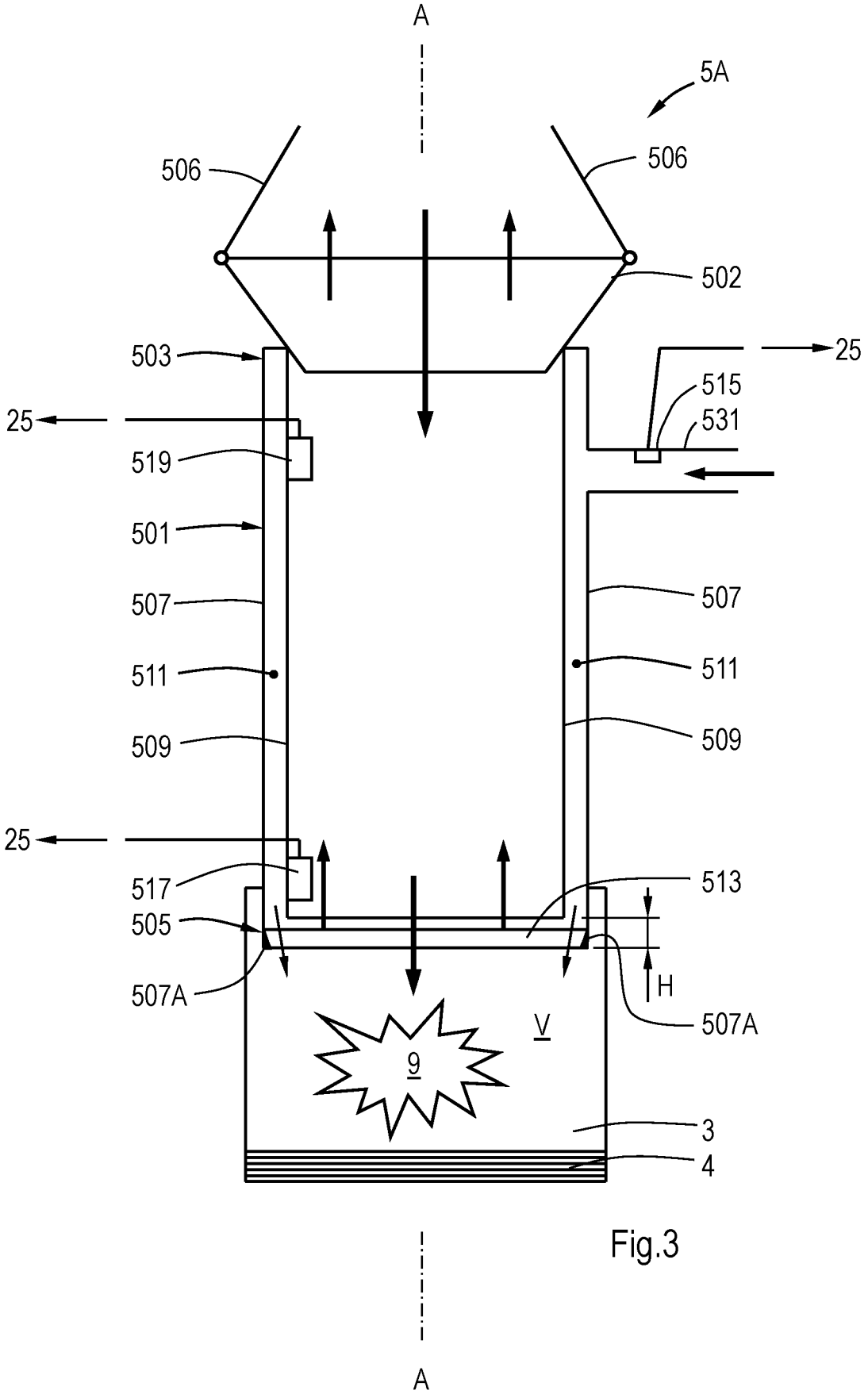
FIG. 3 schematically shows, in cross section, a package forming device of an embodiment of an apparatus and indicates at least part of an embodiment of a method.

FIG. 3 schematically shows, in cross section, a package forming device 5A for an apparatus in accordance with the principles set out herein, e.g. as indicated in FIG. 1. The device 5A comprises an enclosed produce supply channel 501, extending in an axial direction A, here a pipe in the form of a vertical chute for the produce from a hopper 502. The channel 501 has a produce filling end 503 and a packaging end 505. Optionally, the hopper 502 is closable, e.g. by one or more covers 506, to function as a lock for reduction of gas loss. The channel 501 and the hopper 502 or other produce supply may be integrated or separate and any spaces in between may be closed against gas leaks or rather have one or more gas outlets. The package forming device 5A is configured to fill packages 3 at or near the packaging end 505 with a portion of produce 9 supplied through the chute. The package 3 may also be formed around the channel 501 from a (microperforated) sheet of the packaging material, e.g. by welds or seals such as seal 4.

The shown channel 501 is double walled, having an outer wall 507 and an inner wall 509 providing a gas flow channel 511 in between and around the circumference channel, connected to a gas supply conduit 531 for supplying a gas mixture, in particular a gas mixture comprising an atmosphere modification gas and pressurised air, to the channel (FIG. 3, thin arrows). In FIG. 3, the inner wall 509 of the channel ends within the outer wall 507, above the bottom end of the latter (by an offset H). Thus, the channel 501 has a gas inlet 513 into the package 3 to be filled and the channel 501 extending substantially around the circumference of the channel inner wall 509 for supplying the gas mixture at or near the packaging end 505 into the produce supply channel and/or the package 3 (FIG. 3, thin arrows). The offset H facilitates definition of the end of the channel 501 and directing the gas into the channel 501. The bottom end of the outer wall 507 may be provided with an inward protrusion 507A for directing a gas flow.

The channel 501 is provided with a first gas sensor 515 upstream of the gas inlet 513, a second gas sensor 517 near the packaging end 505 close to the gas inlet 513, and a third gas sensor 519 near the filling end 503 both sensors 517 and 519 are arranged on an inside of the channel 501 and downstream of the gas inlet 513. Each of the gas sensors 515, 517, 519 is connected to a gas composition detector and controller, possibly integrated (cf. controller 25 of FIG. 1).

In use for manufacturing a modified atmosphere package, an unfilled package 3 is provided at the packaging end 505 of the channel 501, here surrounding it, and a gas mixture is supplied to the channel 501 and the package 3 through the gas inlet 513 (FIG. 3, thin arrows). Thus, the atmosphere at and near the packaging end 505 and in the package 3 is modified relative to the initial, un-modified ambient atmosphere. Establishment of a sufficiently modified atmosphere can be determined by detection of predetermined (not necessarily identical) gas compositions with the second and third sensors 517 and 519. Then a portion of produce 9 is provided into the channel 501 from the filling end 503 and filled into the package 3 (FIG. 3, bold arrow and shape 9). The portion 9 may be supplied in one instant or in a series of partial portions. Thereafter the filled package 3 may be closed. Thus a closed modified atmosphere package 3 is formed defining a package volume V and containing in the package volume V the portion of produce 9 and modified atmosphere containing a gas mixture of at least one atmosphere modification gas and pressurised air in the package volume V.

The method can thereafter be repeated with a subsequent package and portion of produce 9. If filling of the subsequent package is slowed for some reason, gas introduction may be reduced and after some time stopped or restarted at or before restarting of the filling process, based on detection data from the sensors 515, 517, 519.

The disclosure is not restricted to the above described embodiments which can be varied in a number of ways within the scope of the claims. For instance, the package may be provided with an overpressure relative to the ambient atmosphere. Packages may be supported on a transporter during filling. Packages may be closed by hand. Gas composition sensors may be placed differently and/or be formed as an optical detector. Weighing devices may be added. A (micro)perforator may be absent. The apparatus and/or method may be provided as/performed on new apparatus but are also possible as a retrofit. A chute-based packaging machine need not be double walled but may have one or more gas and/or air filling ducts. The sensor 515 or a further gas sensor may be located in a buffer tank 278.

A packaging space of a tray sealing device may be defined by openable and closable covers.

Elements and aspects discussed for or in relation with a particular embodiment may be suitably combined with elements and aspects of other embodiments, unless explicitly stated otherwise.

The invention claimed is:

1. A method of manufacturing a modified atmosphere package comprising steps of:

providing a portion of packaging material;

providing a portion of produce;

providing the portion of the packaging material with one or more microperforations;

forming, from the portion of packaging material and the portion of produce, a closed package defining a package volume and containing in the package volume the portion of produce and a modified atmosphere;

wherein the modified atmosphere is modified with respect to ambient atmosphere;

wherein the method comprises providing the modified atmosphere in the package volume by providing a gas mixture of at least one atmosphere modification gas and pressurized air in the package volume.

2. The method according to claim 1, comprising providing the pressurized air by compressing air taken from the ambient atmosphere at or near a location where the method is performed.

3. The method according to claim 1, wherein the method comprises measuring at least one of a composition, an amount and a flow rate of at least one of air to be pressurized into the pressurized air, the pressurized air and the gas mixture, prior to introducing the gas mixture into a packaging space.

4. The method according to claim 1, wherein the step of forming the package containing the portion of produce and the modified atmosphere is performed in a packaging space comprising a gas outlet, and the method comprises introducing the gas mixture into the package volume in the packaging space, and wherein the method comprises measuring at least one of a composition, an amount and a flow rate of gas at or near the gas outlet.

5. The method according to claim 1, comprising determining a respiration property of the produce to be packaged and determining on the basis of the determined respiration property of the produce to be packaged at least one of a composition of the modifying atmosphere.

6. The method according to claim 1, comprising manufacturing a series of modified atmosphere packages using the method of claim 1, wherein for each package of the series the step of forming the package containing the portion of produce and the modified atmosphere is performed in a packaging space, wherein the method comprises providing the packaging space with the gas mixture, before and/or after forming successive packages.

7. An apparatus for manufacturing a modified atmosphere package, comprising:

a perforator for providing the packaging material with one or more microperforations, a device for forming, from a portion of packaging material and a portion of produce, a closable package which when closed defines a package volume and contains in the package volume the portion of produce and a modified atmosphere;

a supply of pressurized air and a supply of at least one atmosphere modification gas; and a device for providing a gas mixture of the at least one atmosphere modification gas and the pressurized air in the package volume.

8. The apparatus according to claim 7, wherein the apparatus is configured to close the package.

9. The apparatus according to claim 7, wherein the apparatus comprises a gas inlet for supplying the gas mixture in or near the package, and the apparatus comprises at least one gas sensor positioned upstream of the inlet, and the gas sensor is configured to detect at least one component of the gas mixture.

10. The apparatus according to claim 9, wherein the apparatus comprises a controller operably connected with the at least one gas sensor, and the controller is operably connected with one or more regulators for controlling at least one of a composition and a flow of the gas mixture, in response to a signal from the at least one gas sensor, and/or the controller is operably connected with the device for forming a package and/or a supply of produce.

11. The apparatus according to claim 7, wherein the apparatus comprises a gas inlet for supplying the gas mixture in or near the package, at least one of a gas outlet and a produce inlet for supplying the produce to the apparatus and/or to the package, positioned downstream of the gas inlet, and at least one gas sensor positioned downstream of the inlet and upstream of, or at or near, the at least one of the gas outlet and/or the produce inlet, and the at least one gas sensor is configured to detect at least one component of the gas mixture.

12. The apparatus according to claim 7, wherein the apparatus comprises an enclosed produce supply channel having a produce filling end and a packaging end, the apparatus is configured for filling the package at or near the packaging end with produce supplied through the channel, the apparatus comprises a gas inlet into the produce supply channel for supplying the gas mixture at or near the packaging end into the produce supply channel, and the apparatus comprises at least one gas sensor upstream of the gas inlet and/or at least one gas sensor at or near the filling end, and the at least one gas sensor is configured to detect at least one component of the gas mixture.

13. The apparatus according to claim 7, wherein the apparatus comprises a produce supply channel having a produce filling end and a packaging end, and the apparatus is configured for filling the package at or near the packaging end with produce supplied through the channel, and the apparatus comprises a plurality of gas inlets into the produce supply channel for supplying the gas mixture at or near the packaging end into the produce supply channel, and/or the supply channel comprises at least partially a double wall providing a gas flow channel inside the double wall and comprising a plurality of gas inlets into the produce supply channel and/or a gas inlet having an inlet opening extending for more than about 25% of the circumference of the channel inner wall for supplying the gas mixture at or near the packaging end into the produce supply channel and/or the package.

14. The apparatus according to claim 7, wherein the apparatus comprises at least one of a controller for the perforator, a camera, and a system for determining a target package atmosphere which system may comprise a sensor and a controller.

15. A method of manufacturing a modified atmosphere package comprising steps of:

providing a portion of packaging material;

providing a portion of produce;

forming, from the portion of packaging material and the portion of produce, a closed package defining a package volume and containing in the package volume the portion of produce and a modified atmosphere;

wherein the modified atmosphere is modified with respect to the ambient atmosphere; and wherein the method comprises providing the modified atmosphere in the package volume by providing a gas mixture comprising at least one atmosphere modification gas and pressurized air in the package volume;

forming the package containing the portion of produce and the modified atmosphere in a device provided with a packaging space;

providing the at least one atmosphere modification gas and the pressurized air;

forming the gas mixture by mixing the at least one atmosphere modification gas and the pressurize air, wherein the gas mixture has an oxygen concentration lower than 10% oxygen; and introducing the gas mixture into the packaging space.

16. The method according to claim 15, wherein the method comprises measuring at least one of a composition, an amount and a flow rate of at least one of air to be pressurized into the pressurized air, the pressurized air and the gas mixture, prior to introducing the gas mixture into a packaging space.

17. The method of claim 15, wherein, the gas mixture has an oxygen concentration between 10% and 0.5% oxygen.

18. An apparatus for manufacturing a modified atmosphere package, comprising:

a device for forming, from a portion of packaging material and a portion of produce, a closable package which when closed defines a package volume and contains in the package volume the portion of produce and a modified atmosphere; and a device for providing the modified atmosphere by providing a gas mixture comprising at least one atmosphere modification gas and pressurized air in the package volume;

a supply of the pressurized air and a supply of the at least one atmosphere modification gas;

a device for forming the gas mixture by mixing the at least one atmosphere modification gas and the pressurized air to an oxygen concentration of the gas mixture lower than 10% oxygen, and a device for providing the gas mixture of the at least one atmosphere modification gas and the pressurized air in the package volume.

19. The apparatus according to claim 18, wherein the apparatus comprises a gas inlet for supplying the gas mixture in or near the package, and at least one gas sensor positioned upstream of the inlet configured to measure at least one of a composition, an amount and a flow rate of at least one of air to be pressurized into the pressurized air, the pressurized air and the gas mixture, prior to introducing the gas mixture into the packaging space.

20. The apparatus according to claim 18, wherein the device for forming the gas mixture by mixing the at least one atmosphere modification gas and the pressurized air is configured for mixing the gas mixture to an oxygen concentration of the gas mixture between 10% and 0.5% oxygen.

* * * * *